US006979186B2

(12) United States Patent
Schmit et al.

(10) Patent No.: US 6,979,186 B2
(45) **Date of Patent: *Dec. 27, 2005**

(54) INSTALLATION FOR PRODUCING A SPUNBONDED FABRIC WEB WITH FILAMENT DIFFUSER AND SEPARATION BY ELECTROSTATIC PROCESS

(75) Inventors: Laurent Schmit, Saint Martin d'Heres (FR); Rosario Maggio, Varese (IT)

(73) Assignee: Reiter Perfojet, Montbonnot (FR)

( * ) Notice: Subject to any disclaimer, the term of this patent is extended or adjusted under 35 U.S.C. 154(b) by 170 days.

This patent is subject to a terminal disclaimer.

(21) Appl. No.: 10/399,211

(22) PCT Filed: Oct. 12, 2001

(86) PCT No.: PCT/FR01/03163

§ 371 (c)(1),
(2), (4) Date: Apr. 14, 2003

(87) PCT Pub. No.: WO02/34990

PCT Pub. Date: May 2, 2002

(65) Prior Publication Data

US 2004/0028763 A1 Feb. 12, 2004

(30) Foreign Application Priority Data

Oct. 20, 2000 (FR) ..... 00 13446

(51) Int. Cl.[7] ..... D04J 3/00
(52) U.S. Cl. ..... 425/72.2; 425/174.8 E; 425/382.2; 156/441
(58) Field of Search ..... 425/66, 72.2, 174.8 R, 425/174.8 E, 382.2; 156/433, 441, 167, 181

(56) References Cited

U.S. PATENT DOCUMENTS

| | | | | |
|---|---|---|---|---|
| 3,325,906 A | | 6/1967 | Franke | 34/10 |
| 3,338,992 A | | 8/1967 | Kinney | 264/24 |
| 3,766,606 A | | 10/1973 | Piper et al. | 19/65 T |
| 4,009,508 A | * | 3/1977 | Sternberg | 19/299 |
| 4,148,595 A | | 4/1979 | Bednarz | 425/75 |
| 4,961,695 A | * | 10/1990 | Hirschmann et al. | 425/72.2 |
| 5,225,018 A | | 7/1993 | Zeldin et al. | 156/167 |
| 5,397,413 A | * | 3/1995 | Trimble et al. | 156/167 |
| 5,460,500 A | * | 10/1995 | Geus et al. | 425/66 |
| 5,648,041 A | * | 7/1997 | Rodgers et al. | 264/555 |
| 6,783,722 B2 | * | 8/2004 | Taylor | 264/465 |

FOREIGN PATENT DOCUMENTS

JP 10-292256 11/1998 ..... D04H 3/16

OTHER PUBLICATIONS

Patent Abstracts of Japan, vol. 1999, No. 10, Aug. 31, 1999, & JP 11 131355 A (Asahi Chem. Ind. Co. Ltd.) May 18, 1999.

(Continued)

*Primary Examiner*—Joseph S. Del Sole
(74) *Attorney, Agent, or Firm*—Pearne & Gordon LLP

(57) ABSTRACT

The invention concerns an installation for producing a spunbonded fabric web comprising a diffuser defining for the drawn filaments a passage with diverging cross-section, and mounted a certain distance from the slot attenuator, and a conveyor receiving the filaments coming out of the diffuser. The uniformity of the web is enhanced by means of a device separating the filaments from each other by electrostatic process mounted at a higher level higher than the bottom of the passage.

12 Claims, 3 Drawing Sheets

OTHER PUBLICATIONS

Patent Abstracts of Japan, vol. 1998, No. 14, Dec. 31, 1998, & JP 10 251959 A (Oji Paper Co. Ltd.) Sep. 22, 1998.

Patent Abstracts of Japan, vol. 018, No. 678 (C-1290), Dec. 20, 1994, & JP 06 264347 A (Unitika Ltd.), Sep. 20, 1994.

* cited by examiner

INSTALLATION FOR PRODUCING A SPUNBONDED FABRIC WEB WITH FILAMENT DIFFUSER AND SEPARATION BY ELECTROSTATIC PROCESS

BACKGROUND OF THE INVENTION AND RELATED ART

The present invention relates to plants or installations for producing a nonwoven web usually called by the generic name "spunbond", which is formed from continuous synthetic filaments.

A plant or installation for producing a nonwoven web is already known that comprises, in succession from the top down, a means of generating a curtain of filaments, a slot attenuator for drawing the filaments of the curtain, a diffuser, that defines, for the attenuated filaments, a passage having a cross section, along the thickness of the curtain, that never decreases and, at least once, increases, and a conveyor for collecting the filaments exiting the diffuser.

In a plant or installation of this kind, in which the attenuation is performed by a slot attenuator which is continuous over the entire production width, the electrostatic charge on the filaments before the attenuator, as proposed in U.S. Pat. No. 3,325,906 for a machine with a "gun"-type attenuator, would cause the filaments to stick to the walls of the attenuator. In addition, an electrostatic device placed at the attenuation inlet would represent real danger for operators having to intervene during production in this zone lying between the exit of the spinneret and the attenuation zone. To alleviate these risks, for the safety of the operators, the latter should be prevented from having access to this zone during production, which would constitute an additional drawback.

The means for generating a curtain of filaments usually comprises an extruder intended to extrude a molten organic polymer through a spinneret drilled with numerous holes so as to form a curtain of filaments and, beneath the spinneret, a device for cooling the curtain of filaments. The slot attenuator for attenuating the filaments of the curtain generally has opposed side walls and opposed end walls that define an oblong inlet slot for receiving the filaments and an oblong outlet slot from which the filaments exit. A slot-shaped passage extends between the inlet and the outlet and the filaments pass therethrough, being attenuated by the injection of a stream of air into the slot-shaped passage, which stream is sufficient to attenuate the filaments. Beneath this slot attenuator for attenuating the filaments of the curtain is the diffuser, which is intended to spread out the incoming curtain. Since the diffuser diverges or is flared downward, the curtain that passes through it progressively spreads out as it falls. The web which thus forms on the collecting conveyor placed beneath the diffuser is thus more uniform.

SUMMARY OF THE INVENTION

The invention aims to further improve the uniformity of the web, this also being reflected in an improvement in the appearance and the mechanical strength, while ensuring safety of the operators.

According to the invention, an electrostatic separator is provided for separating the filaments from one another, this separator being mounted at a point higher than the bottom of the passage defined in the diffuser and lower than the top of the slot attenuator. This electrostatic separator is especially mounted toward the top of the diffuser, for example in the top three-quarters and preferably in the top quarter. It may also be mounted at the bottom of the slot attenuator.

By subjecting the filaments of the curtain to the action of the electrostatic separator, which has the effect of creating mutual repulsion of the filaments of the curtain whatever their position in the curtain, just before or at the start of the flared diffuser, the effect of the widening of the curtain by the flared shape of the diffuser, which is essentially manifested on the faces of the curtain, is combined with the electrostatic effect, which is also manifested within the core of the curtain, without the electrostatic action on the filaments on the faces of the curtain thereby having any tendency to bring the filaments into excessive contact with the walls of the diffuser, since the latter flares out. Furthermore, with the electrostatic separator acting on the filaments while they are still close together, either at the outlet of the slot attenuator or at the start of the diffuser, it is possible to keep the supply voltage for the electrostatic separator at a relatively low value, for example between 10 and 40 kV, for which the filaments are not pushed against the opposed wall, thereby preventing the formation of electric arcs that would produce serious defects in the web. The consumption of electricity by the plant remains low.

Preferably, the diffuser is at a certain distance from the slot attenuator, especially at a distance of 3 to 20 mm, preferably 5 to 13 mm. This distance makes it possible to have a lateral inflow of air on each side of the diffuser by the venturi effect, the air ejected from the attenuation slot with a high velocity (about 50 to 60 meters per second) generating strong suction at the inlet of the diffuser. The amount of air drawn in by the venturi effect depends on the velocity of the air ejected via the attenuation slot and the distance separating the attenuation slot from the diffuser.

When the electrostatic separator is located toward the top of the diffuser, it is advantageous for the width of the top of the passage of the diffuser to be very slightly greater, for example by 2 to 5 mm, than that of the attenuation slot facing it, so as to prevent some of the filaments exiting the attenuation slot from touching the walls of the diffuser, which would result in the appearance of numerous defects. Good results have been obtained for an attenuation slot width between 5 and 15 mm and, correspondingly, a width at the top of the diffuser passage between 7 and 20 mm.

Preferably, at least one lateral opening and up to five lateral openings are provided on one of the walls or on both walls of the diffuser. These openings, which extend over the entire length of the diffuser and run to the outside, make it possible to balance the static pressure established in the diffuser, thereby preventing the streams of air separating along the walls. These openings may have widths of 3 to 10 mm.

According to one embodiment, the diffuser is formed from two divergent plates, the angle between the two plates being between 3° and 30°, and preferably between 3 and 10°, and able to be adjusted so as to optimize the rate at which the air slows down in the diffuser and the velocity of the air ejected from the diffuser before the filaments are laid on the conveyor. This allows the velocity to be adjusted according to the characteristics of the product manufactured, the grammage, the linear density of the filaments, and other factors. Good results have been obtained with a diffuser having a length between 100 and 600 mm, while the distance between the bottom of the diffuser and the conveyor is between 50 and 500 mm.

The electrostatic separator has needles which are preferably set back from the passage defined in the diffuser, for example by about 1 mm, from the surface of the wall so as to prevent filaments from agglomerating at the needles during the plant or installation startup phase.

BRIEF DESCRIPTION OF THE DRAWINGS

In the appended drawings, given solely by way of example.

DETAILED DESCRIPTION OF THE DRAWINGS

Figure 1:
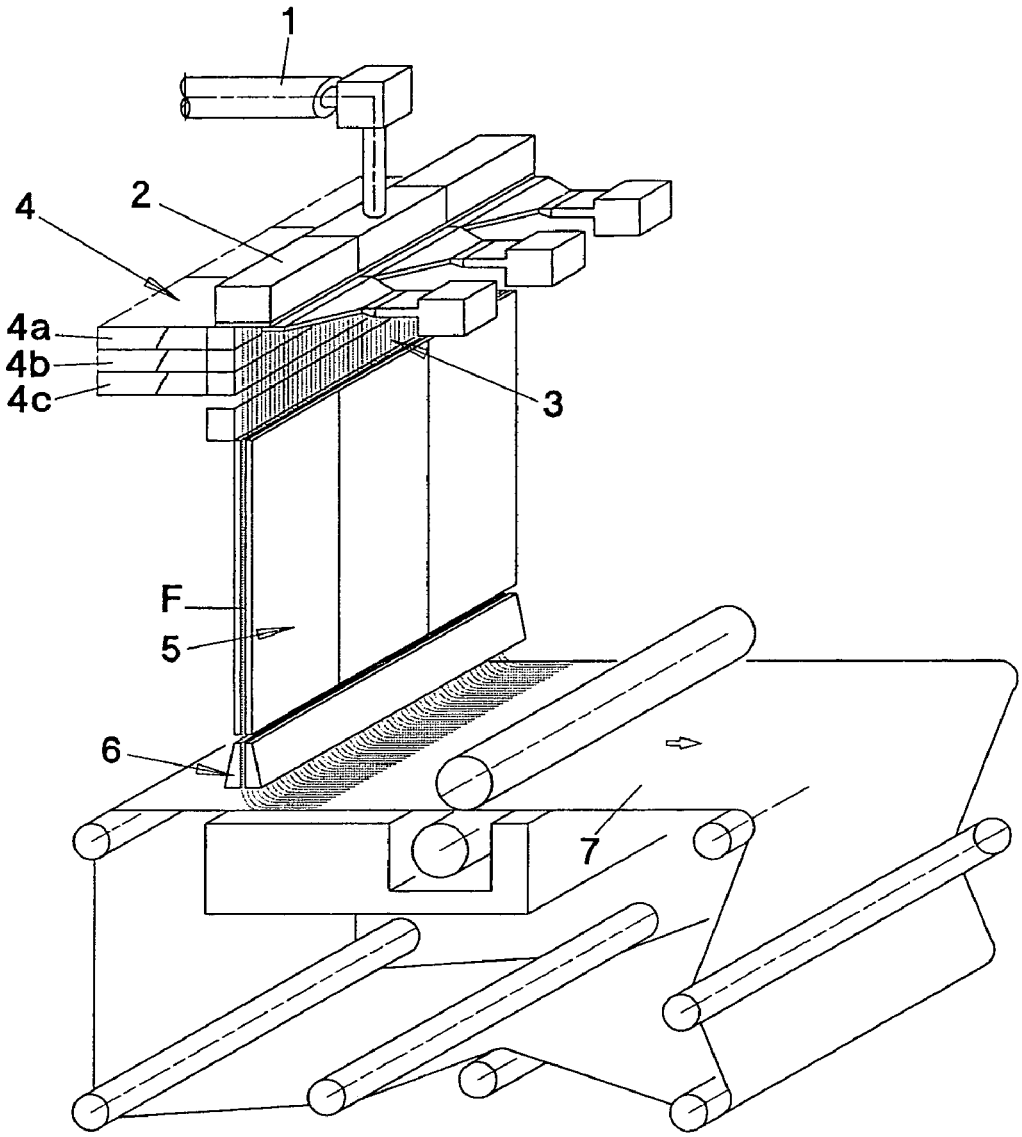
FIG. 1 is a perspective view of a plant or installation according to the invention.

The plant comprises an extruder 1 fed with a synthetic polymer and a spinneret 2 for forming a curtain of filaments 3. The spinneret is formed from a plate having numerous holes with a diameter that depends on the filaments extruded. These holes are distributed over a number of parallel rows. For example, there are 18 rows over a spinneret width of 140 mm.

At the exit, that is to say just beneath the spinneret 2, there is a cooling unit 4 for lowering the temperature of the filaments. The cooling unit 4 is composed of a number of successive zones 4*a*, 4*b*, 4*c*, which allow the curtain of filaments 3 to be subjected to streams of air whose velocity and temperature may be adjusted. The length of this cooling zone may be around 1 200 mm.

Downstream, and therefore beneath this cooling unit 4, there is a conventional attenuator 5 with a slot F. It is composed of two walls that define between them a passage in the form of a slot F, into which pressurized air, for example at a pressure of 0.5 bar, is injected. This slot attenuator makes it possible to suck the curtain of filaments and entrain it by high-velocity air streams, thereby attenuating the filaments.

Figure 3:
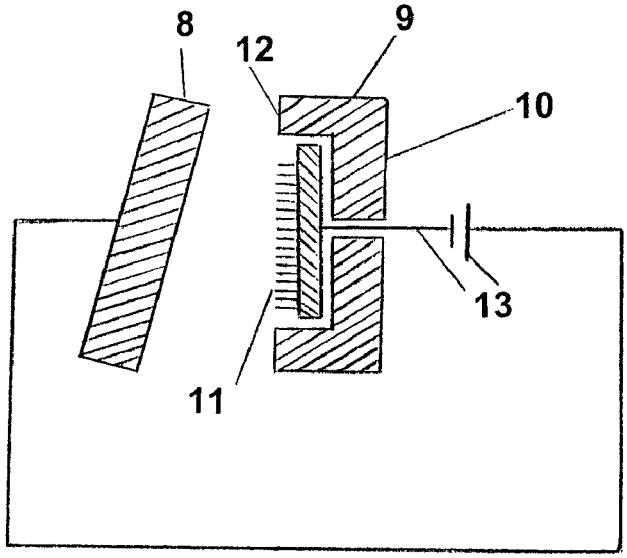
FIG. 3 is a sectional view on a larger scale of the upper part of the diffuser of FIG. 2.

In a preferred embodiment, as shown in FIG. 3, an electrostatic filament separator is provided after the slot attenuator 5. This separator essentially comprises two plates 8 and 9 facing each other. In one of the plates, there is a housing for mounting a bar 10 made of an electrically conducting material, from which bar emanate, toward the plate 8, needles 11. The needles do not project beyond the inner face 12 of the wall 9. The plate 8 and at the top of the diffuser and the bar 10 are connected to a current generator 13 so that an electric field is established between the needles 11 and the plate 8.

Figure 2:
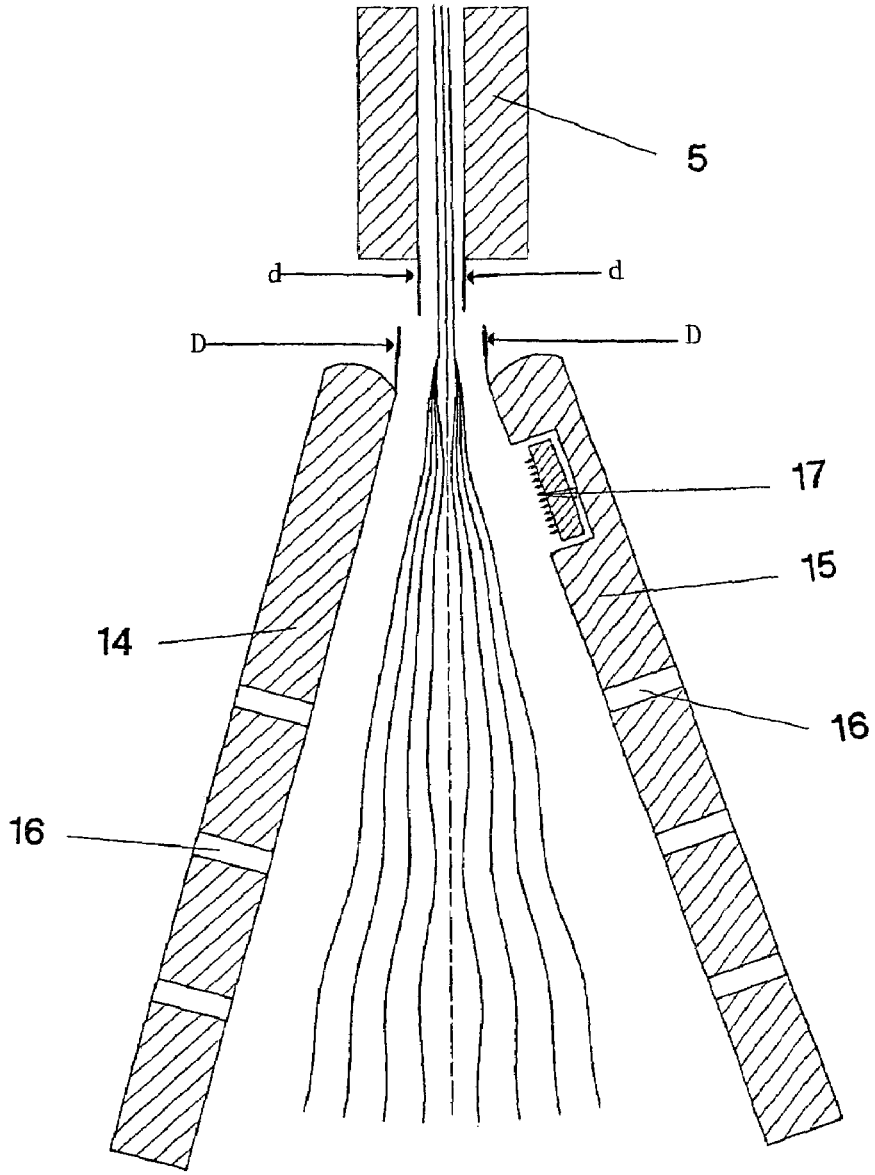
FIG. 2 is a sectional view of the diffuser.

Mounted beneath the slot attenuator 5 is a diffuser 6. This diffuser 6, shown in particular in FIG. 2, has two walls 14, 15 making an angle of 5° between them and each being provided with three openings 16 extending over the entire length. The diffuser 6 is placed 10 mm below the attenuator 5 and the width d of the attenuation slot is just less than the width D of the top of the passage defined by the diffuser 6. Mounted in the wall 15 of the diffuser 6 is the electrostatic separator shown in FIG. 3.

There is a conventional conveyor 7 beneath the diffuser 6.

In a variant, the electrostatic separator is placed at the bottom of the slot attenuator.

What is claimed is:

1. An installation for producing a nonwoven web, comprising, from the top down, a means for generating a curtain of filaments having a length in the direction of filament travel through the installation, a width and a thickness, a cooling unit positioned below the filament generating means for impinging cooling air onto the curtain of filaments to lower the temperature of the curtain of filaments, a slot attenuator for drawing the filaments of the curtain, a diffuser that defines, for the attenuated filaments, a passage for receiving the full width of the curtain of filaments and spreading out the curtain entering the passage, the passage having a length extending in the direction of filament travel and a passage width extending through the thickness of the attenuated curtain of filaments, the passage width never decreasing in size and, at least once, increasing in size in the direction of filament travel, and a conveyor for collecting the filaments exiting the diffuser, characterized in that the diffuser is disposed a distance from the slot attenuator to form an unobstructed opening to the ambient air and to provide unimpeded and uniform lateral inflow of air on each side of the diffuser by the venturi effect, and there is an electrostatic separator for separating the filaments, said separator being mounted at a point higher than the bottom of the passage and lower than the top of the slot attenuator.

2. The installation as claimed in claim 1, characterized in that the separator is mounted at the bottom of the slot attenuator.

3. The installation as claimed in claim 1, characterized in that the separator is mounted toward the top of the diffuser.

4. The installation as claimed in claim 3, characterized in that the separator is mounted in the top three-quarters of the diffuser and preferably in the top quarter.

5. The installation as claimed in claim 1, characterized in that the diffuser is mounted at a certain distance from the slot attenuator, preferably at a distance of 3 to 20 mm.

6. The installation as claimed in claim 1, characterized in that the diffuser has lateral openings extending over the entire length.

7. The installation as claimed in claim 2, characterized in that the width of the attenuation slot is smaller than the width of the passage at the top of the diffuser.

8. The installation as claimed in claim 3, characterized in that the separator has needles that are set back from the passage defined in the diffuser.

9. The installation as claimed in claim 4, characterized in that the separator has needles that are set back from the passage defined in the diffuser.

10. The installation as claimed in claim 5, characterized in that the separator has needles that are set back from the passage defined in the diffuser.

11. The installation as claimed in claim 6, characterized in that the separator has needles that are set back from the passage defined in the diffuser.

12. The installation as claimed in claim 7, characterized in that the separator has needles that are set back from the passage defined in the diffuser.

* * * * *

UNITED STATES PATENT AND TRADEMARK OFFICE

CERTIFICATE OF CORRECTION

PATENT NO. : 6,979,186 B2
APPLICATION NO. : 10/399211
DATED : December 27, 2005
INVENTOR(S) : Laurent Schmit et al.

It is certified that error appears in the above-identified patent and that said Letters Patent is hereby corrected as shown below:

On the TITLE page, Section (73) the Assignee Name should be corrected to read:

--Rieter Perfojet, Montbonnot (FR)--.

Signed and Sealed this

Fifteenth Day of August, 2006

JON W. DUDAS
*Director of the United States Patent and Trademark Office*